United States Patent [19]

Blakelock

[11] 4,051,659

[45] Oct. 4, 1977

[54] PRODUCTION OF CARBON FIBRE

[75] Inventor: Harold Dennis Blakelock, South Ruislip, England

[73] Assignee: Morganite Modmor Limited, London, England

[21] Appl. No.: 658,368

[22] Filed: Feb. 17, 1976

[30] Foreign Application Priority Data

Feb. 17, 1975 United Kingdom ..... 6583/75

[51] Int. Cl.[2] ..... D01F 9/12; D01F 9/14; D02G 3/02

[52] U.S. Cl. ..... 57/140 R; 57/157 R; 57/157 TS; 260/37 R

[58] Field of Search ..... 57/140 R, 157 R, 157 TS, 57/139; 8/115.5, 140; 423/447

[56] References Cited

U.S. PATENT DOCUMENTS

| | | | |
|---|---|---|---|
| 3,412,062 | 11/1968 | Johnson et al. | 423/447 X |
| 3,702,054 | 11/1972 | Araki et al. | 57/157 TS |
| 3,841,079 | 10/1974 | Ram et al. | 57/140 R |

*Primary Examiner*—John Petrakes

*Attorney, Agent, or Firm*—Larson, Taylor and Hinds

[57] ABSTRACT

Production of carbon fibre from a multifilament tow of organic precursor fibre, by heat treatment in an oxygen containing atmosphere and subsequent carbonization optionally followed by graphitization, the tow being given a twist between the oxygen treatment and carbonization, which twist is made permanent by the carbonization and maintains the fibres within the tow during the carbonization and subsequent handling.

11 Claims, 1 Drawing Figure

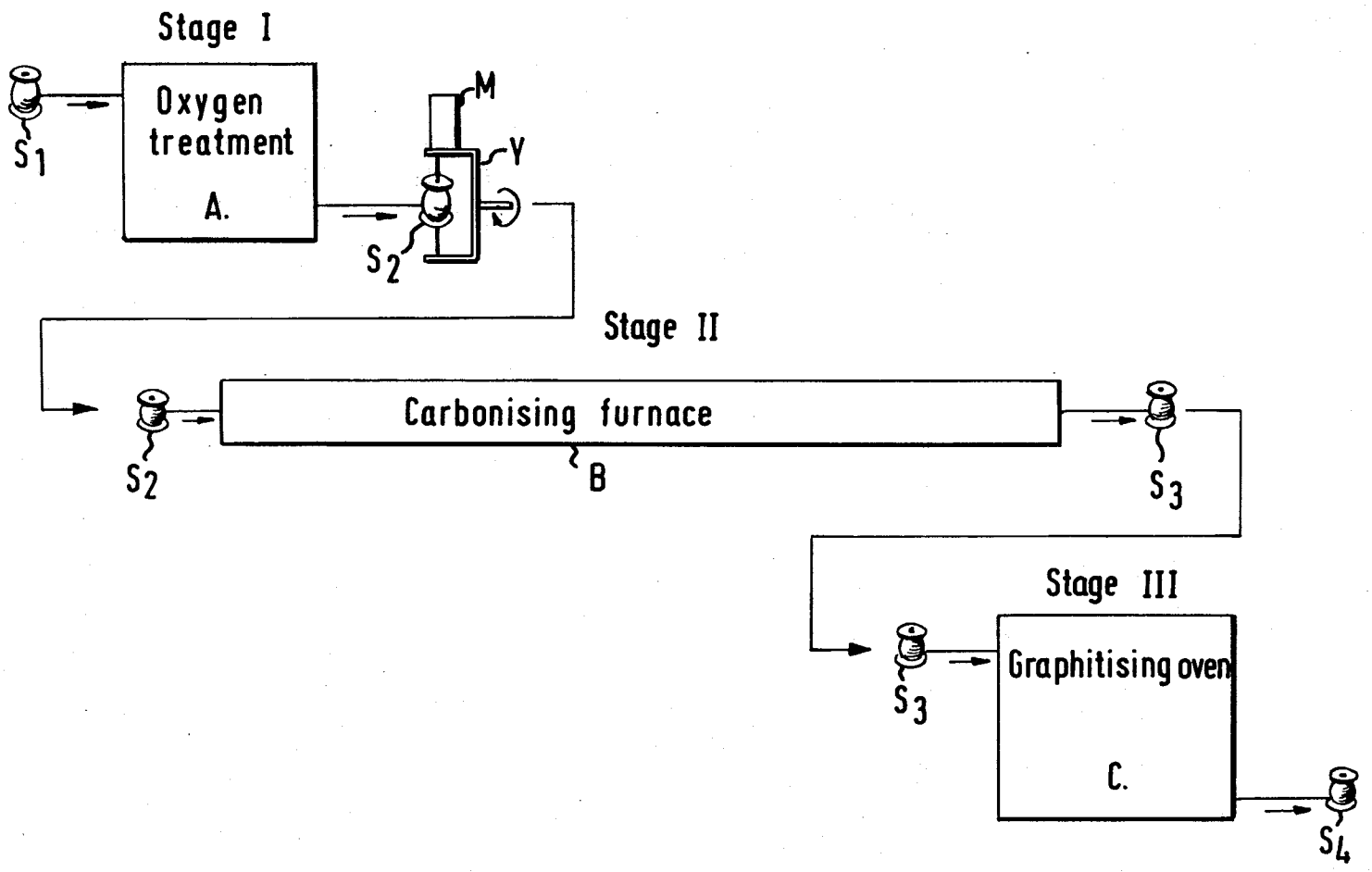
Stage I
Oxygen treatment
A.
M
Y
S1
S2
Stage II
Carbonising furnace
B
S2
S3
Stage III
Graphitising oven
C.
S3
S4

PRODUCTION OF CARBON FIBRE

The invention relates to the production of carbon fibre.

Carbon fibre can be produced by the heating of polyacrylonitrile or other organic fibre precursors to carbonising temperatures of 100° C and above, preferably 1000°- 2000° C. Further, in a preferred process, the precursor is first heated in an oxygen-containing atmosphere at low temperatures, e.g. up to 300° C, and preferably at 200°- 300° C for 1 to 3 hours and subsequently heated to carbonising temperature in an inert atmosphere. The oxygen treatment is desirably carried out for a time sufficient to ensure oxidation throughout the filament, fully stabilising it for subsequent carbonisation. A time of 3 hours at 250° C is for example amply sufficient with 1½ denier fibre. The subsequent carbonisation is carried out for a time sufficient to give essentially complete conversion of the precursor to carbon, as determined by analysis, and to give the final strength properties required.

If fibres of highest ultimate tensile strength and Young's Modulus are required, then the carbonised fibre can be graphitised by further heating in an inert atmosphere to temperatures of 2000° C and above, preferably 2000°- 3000° C.

Improved ultimate fibre properties are also obtained when the fibres are maintained under tension during the initial heating in the oxidising atmosphere, the tension preferably being sufficient to prevent shrinkage, or at least to prevent shrinkage of more than 5%, and more preferably sufficient to give an elongation, for example of 10%.

Handling problems in production and use of carbon fibre for both structural and non-structural uses are considerable, because the fibre is conveniently processed in the form of multifilament tows, i.e. tows of 2000 to 20,000, suitably 5,000, 10,000 or more, separate filaments of for example 0.5 to 5 denier, most suitably of 1 to 2 denier. (Denier is the weight in grams of 9,000 meters of single filament). The filaments, which are very fine, for example 7 to 9 microns diameter, tend to fluff up or fret, preventing the final tow from, for example, being laid neatly in use as reinforcement and particularly proving a nuisance in applications involving conversion of the multifilament tows into woven or braided forms. The woven forms are useful for example in making carbon-carbon composites such as friction materials, and the braided forms as chemically resistant gland packing.

We have found that satisfactory handling is given by imparting a twist to the tow, provided the twist is imparted between the oxygen treatment and the carbonisation.

The invention, therefore, lies in the production of carbon fibre from a multifilament of polyacrylonitrile or other organic precursor fibre, for example of 2,000 to 20,000 filaments, by heat treatment in an oxygen-containing atmosphere and subsequent carbonisation optionally followed by graphitisation, the tow being given a twist, for example of 10 to 120 turns/meter, between said treatment and the carbonisation, which twist is made permanent by the carbonisation and maintains the fibres within the tow during the carbonisation and subsequent handling.

The handling problems could, it might be thought, be reduced by imparting twist to the tow at any stage, for example by conventional textile processes in the precursor, or by twisting after production of the carbon fibre, for example immediately prior to conversion into woven or braided forms. Twisting after carbonisation is however found unsatisfactory, in particular because the tow does not hold the twist. The processing of a tow twisted prior to the low temperature treatment is also found unsatisfactory, with extended processing times due it is thought to reduction of the access of oxygen. Further, the use of twisted tows can give rise to handling difficulties on the apparatus used during the oxygen treatment, particularly, as is desirable, where tension, preferably tension at least sufficient to prevent shrinkage of the fibre, is applied. The preferred organic fibre precursor is polyacrylonitrile, but among other suitable precursors are copolymers of acrylonitrile with one or more other monomers e.g. with methyl methacrylate and/ or vinyl acetate, and mixtures of the acrylonitrile polymers or copolymers with other, compatible polymers for example phenolic resins or Friedel-Crafts condensates.

The tow of oxygen-treated fibre is found to be readily twisted without damage and holds the twist satisfactorily after carbonisation. Ultimate tensile strength and Young's Modulus of the final fibre are good, comparable to fibre produced from parallel tows.

The invention is not restricted to imparting any particular degree of twist, nor to the use of any particular method of twisting. However very low degrees of twist compared to those used in conventional textile technology are satisfactory. For example a twist of 10 turns/meter may be all that is required when the final use of the carbon fibre is as the tow and improved manual handleability is the desired property. On the other hand if the tow is to be woven, or braided into tape, 50 turns/meter or more are desirable, giving a great improvement in handleability and fretting resistance in the weaving or braiding. A twist of 70 to 120 turns/meter is optimum; above 120 or 130 a loss in strength as well as length begins to be significant. Ultimate strength of the fibre is somewhat reduced by the twisting but the reduction is not significant.

The twist can be imparted to the tow of oxygen treated fibre by any suitable means. For example, the tow can be spooled, for holding prior to subsequent carbonisation, and the twist can be imparted to the tow before it enters the carbonisation furnace by mounting the spool in a yoke and rotating the yoke as the fibre is drawn through to a take up spool at the other end of the furnace.

Alternatively the twist may be put in as the tow emerges from the oxygen treatment, by taking up on a spool in a rotating yoke or for example by using a false twister.

Alternatively again, the twist may be put in by pulling the tow off the end of a spool, with simultaneous rotation of the spool if more or less than one twist per spool-circumference is required in the tow. For example if the tow is wound on the spool in such a way that an unrestrained spool would freewheel anticlockwise as the tow was pulled off one end (as seen from that end), a clockwise rotation would have to be given to increase the twist or limited anticlockwise rotation allowed to decrease it.

Preferably the twist is put in as the tow comes out of the oxygen treatment.

The spooling allows a bank of oxygen treated fibre to be built up so that different grades of carbon fibre can be made in the carbonising, or carbonising and graphitising, ovens without any need to match production in the oxygen treatment, which may extend over some hours, with throughput in the carbonising and graphitising, which may be quicker.

Optionally after the process of the invention the carbonised or graphitised twisted tow may be subjected to treatments such as coating with polytetrafluoroethylene, for example in an atomised spray or in a dispersion bath to give a 5 % weight for weight coating. Additionally or alternatively, treatments with other polymeric materials, for example polyvinyl acetate can be used, to modify the handling or other properties of the tow and maintain the fibres securely within the tow. P.T.F.E. is a dressing against fretting on textile machines, and for example treated tow is readily braided on conventional machines to sizes such as 1 $cm^2$ cross section braid.

The single drawing FIGURE is a block diagram showing successive stages in a plant for producing carbon fiber in accordance with the invention.

Apart from the twisting operation, it may be considered that the plant and its operation are conventional.

The invention is illustrated by the following Example, referring to the accompanying block diagram drawing.

STAGE I

A 10,000 filament tow of 1½ denier polyacrylonitrile 'Courtelle' (Trade Mark) fibres was passed from a spool $S_1$ into an oxygen treating oven A where it was maintained, wound on a frame preventing shrinkage, for 3 hours at 250° C in air, a time sufficient to ensure oxygen permeation throughout the fibres and to stabilise the fibre fully for subsequent carbonisation. The fibre was collected on a spool $S_2$ turned by an electric motor M, spool and motor being mounted on a yoke Y itself rotated to impart a twist of 50 turns/meter to the tow.

STAGE II

The oxidised fibre was then treated in a tubular carbonising furnace B, running from spool $S_2$ to a further spool $S_3$ and being taken up to 1900° C in a nitrogen atmosphere to give essentially complete carbonisation, as confirmed by analysis to better than 99.9% carbon. This treatment set the twist into the tow so that even if a length was untwisted by hand it reverted to the twisted form. The position of the fibres in the tow was maintained during spooling and other handling, without fluffing or fretting.

STAGE III

A sample of the fibre was then graphitised in an oven C at 2600°– 2700° in helium, being rewound onto spool $S_4$. The graphitisation gave a fibre of ultimate tensile stength $3 \times 10^5$ lb/sq.in. and Young's Modulus $4 \times 10^7$ to $5 \times 10^7$ lb/sq. in. single fibre properties. These properties are of the order of those shown by untwisted material.

I claim:

1. In the production of carbon fibre from a multifilament tow of organic precursor fibre, by heat treatment in an oxygen containing atmosphere and subsequent carbonisation optionally followed by graphitisation, the improvement comprising giving the tow a twist between the oxygen treatment and carbonisation, which twist is made permanent by the carbonisation and maintains the fibres within the tow during the carbonisation and subsequent handling.

2. In the production of carbon fibre according to claim 1, from a multifilament tow of 2,000 to 20,000, 0.5 to 5 denier filaments of organic precursor fibre, by heat treatment in an oxygen-containing atmosphere at 200 to 300° C for 1 to 3 hours under tension a least sufficient to prevent shrinkage of the fibre by more than 5%, subsequent carbonisation at 1000° to 2000° C, and optionally graphitisation at 2000° to 3000° C, the improvement wherein the tow is given a twist of 10 to 130 turns/meter between the oxygen treatment and the carbonisation, which twist is made permanent by the carbonisation and maintains the fibres within the tow during the carbonisation and subsequent handling.

3. Production of carbon fibres according to claim 2, wherein the twist is 50 to 120 turns/meter.

4. Production of carbon fibre according to claim 2, wherein the precursor is a polymer or copolymer of acrylonitrile.

5. Production of carbon fiber as claimed in claim 2 wherein the twist is 70 to 120 turns/meter.

6. A tow of carbon fibre, made by the method of claim 1, having a permanent twist maintaining the fibres within the tow.

7. A tow, according to claim 6, of 2,000 to 20,000 carbon fibres having a permanent twist of 10 to 130 turns/meter maintaining the fibre within the tow.

8. A tow according to claim 7, wherein the twist is 50 to 120, turns/meter.

9. A tow is claimed in claim 7 wherein the twist is 70 to 120 turns/meter.

10. Carbon fibre in woven or braided form, made from a tow according to claim 6.

11. Carbon fiber in the form of a continuous filament tow having a permanent twist maintaining the fibers within the tow, and made by the method of claim 1.

* * * * *